US005921008A

United States Patent [19]

Ruff

[11] Patent Number: 5,921,008

[45] Date of Patent: Jul. 13, 1999

[54] SHOE

[76] Inventor: Stephen M. Ruff, 1974 Wrenfield La., Oviedo, Fla. 32765

[21] Appl. No.: 09/031,176

[22] Filed: Feb. 26, 1998

Related U.S. Application Data

[60] Provisional application No. 60/036,295, Feb. 26, 1997.

[51] Int. Cl.[6] ..... A43B 23/00

[52] U.S. Cl. ..... 36/136; 36/54

[58] Field of Search ..... 36/1, 54, 132, 36/136, 2.6, 137

[56] References Cited

U.S. PATENT DOCUMENTS

| | | | |
|---|---|---|---|
| 601,192 | 3/1898 | Woodside | 36/54 |
| 921,433 | 5/1909 | Miller . | |
| 933,974 | 9/1909 | Meerson . | |
| 2,478,411 | 8/1949 | Martin . | |
| 2,507,991 | 5/1950 | Neal . | |
| 2,897,609 | 8/1959 | Bodkin . | |
| 2,904,901 | 9/1959 | Goldstein . | |
| 3,174,234 | 3/1965 | Weitzner . | |
| 3,769,723 | 11/1973 | Masterson et al. | 36/2.5 |
| 4,372,060 | 2/1983 | Adamik . | |
| 4,458,432 | 7/1984 | Stempski | 36/132 |
| 4,547,982 | 10/1985 | Gamm . | |
| 4,611,416 | 9/1986 | Lin . | |
| 4,630,383 | 12/1986 | Gamm . | |
| 4,697,363 | 10/1987 | Gamm . | |
| 4,726,128 | 2/1988 | Lin . | |
| 4,805,321 | 2/1989 | Tonkel | 36/54 |
| 5,285,586 | 2/1994 | Goldston et al. | 36/137 |
| 5,303,131 | 4/1994 | Wu | 36/137 |
| 5,508,899 | 4/1996 | McCormick | 36/137 |

FOREIGN PATENT DOCUMENTS

| | | | |
|---|---|---|---|
| 910292 | 6/1946 | France | 36/136 |
| 351517 | 4/1922 | Germany | 36/2.6 |
| 3824352 | 2/1990 | Germany . | |
| 093014657 | 8/1993 | WIPO | 36/2.6 |

*Primary Examiner*—Paul T. Sewell
*Assistant Examiner*—J. Mohandesi
*Attorney, Agent, or Firm*—Reising, Ethington, Barnes, Kisselle, Learman & McCulloch, PC

[57] ABSTRACT

An athletic shoe including a sole, a heel, an upper, and a tongue. The tongue includes front and rear layers which define a pocket therebetween. A zipper secures the front and rear layers together to seal the pocket and permit access to the pocket as desired. A drawer is slidably received within a compartment in the heel for storing articles within the heel. A closure strap includes a first end joined to the heel and a second free end which can be secured to a second location on the heel across from the compartment to prevent removal of the drawer from the compartment.

19 Claims, 5 Drawing Sheets

FIG-10
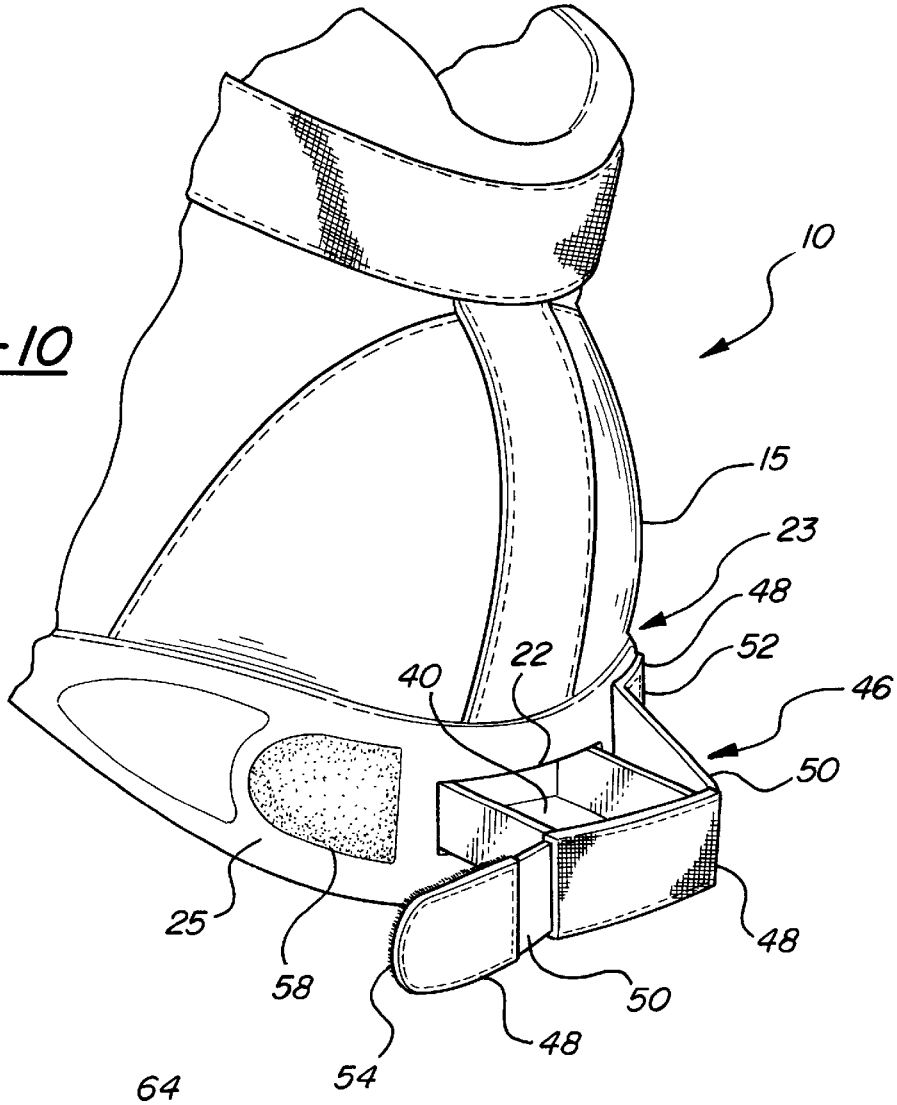
FIG-11
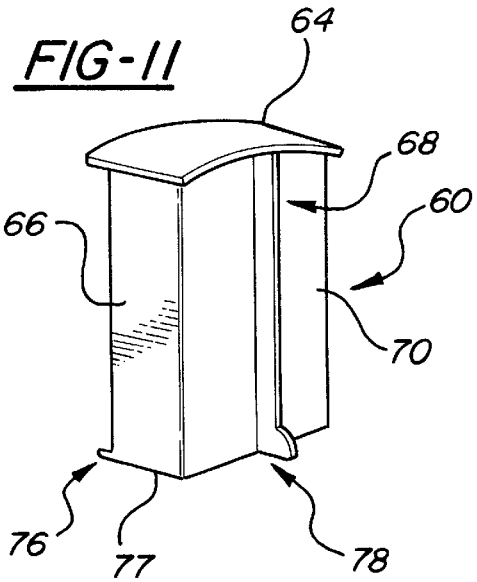
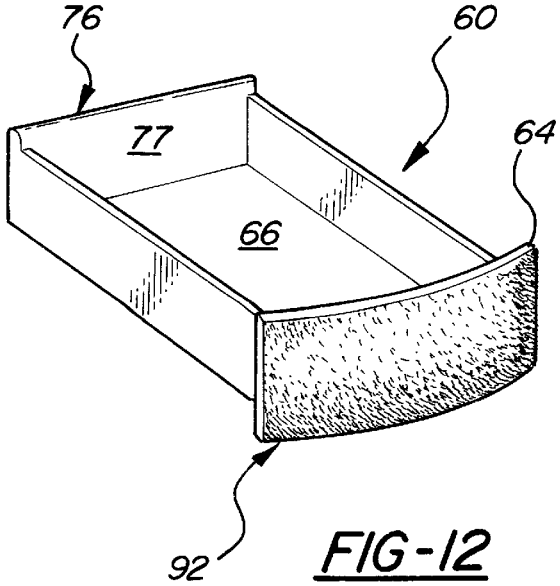
FIG-12

SHOE

This Application claims benefit of Provisional Application 60/036,295, filed Feb. 26, 1997.

FIELD OF THE INVENTION

This invention relates to athletic shoes. More particularly, it relates to an athletic shoe provided with one or more storage compartments incorporated in the shoe structure.

BACKGROUND OF THE INVENTION

There is a need for shoes, especially athletic shoes, which are provided with a storage compartment for small articles such as keys, identification cards, coins, and the like. Such storage compartments should be readily accessible to the person wearing the shoes, and yet it is desirable to have the storage compartment incorporated in the shoe structure without imposing limitations on the styling of the shoe itself.

This invention provides improvements in storage compartments incorporated in the structure of a shoe.

SUMMARY OF THE INVENTION

The present invention relates to a shoe comprising an upper, a sole joined to the upper including a heel, and a compartment within the heel. The compartment includes an opening having a flange extending inwardly from a peripheral edge of the opening, and a drawer is provided which is adapted to be slidably received within the compartment. The drawer includes a bottom end, a front end, and a back end, and an upwardly extending projection is provided on the drawer adjacent the front end. Further, a downwardly extending projection is provided on the drawer adjacent the front end on a bottom surface of the drawer. The projections will engage with the flange surrounding the opening to prevent complete withdrawal of the drawer from the compartment.

The invention also relates to a shoe including an upper, a sole joined to the upper including a heel, and a compartment within the heel having an opening. A drawer is adapted to be slidably received within the compartment and includes a back side which faces outwardly from the compartment. A closure strap is provided including a first end fastened to the shoe on a first side of the compartment opening. A second end of the strap includes one portion of a fastener adapted to engage with a mating portion of the fastener at a location opposite the first side of the compartment opening. The closure strap includes a middle portion joined to the back side of the drawer and an elastic portion between the first end and the middle portion.

The present invention also relates to a shoe including an upper, a sole joined to the upper including a heel, and a compartment within the heel having an opening. A drawer is provided which is adapted to be slidably received within the compartment. A closure strap is provided including a first end fastened to the shoe on a first side of the compartment opening. The strap includes a second end having one portion of a hook and loop fastener adapted to engage with a mating portion of the fastener on the shoe at a location opposite the first side of the compartment opening.

Thus, the present invention provides a convenient storage drawer within a compartment in a shoe which can be securely maintained within the shoe to prevent undesired removal of the drawer from the shoe and the corresponding loss of stored articles.

A complete understanding of this invention may be obtained from the detailed description that follows taken with the accompanying drawings.

DESCRIPTION OF THE DRAWINGS

FIG. 9 is a front view of the closure strap of the third embodiment of

FIG. 10 is a rear perspective view of the storage drawer and closure strap of the third embodiment being inserted into the storage compartment in the heel;

FIG. 11 is a perspective view of a fourth embodiment of the storage drawer illustrating the bottom of the storage drawer;

FIG. 12 is a perspective view of the fourth embodiment of the storage drawer illustrating the top of the storage drawer;

BEST MODE FOR CARRYING OUT THE INVENTION

Figure 1:
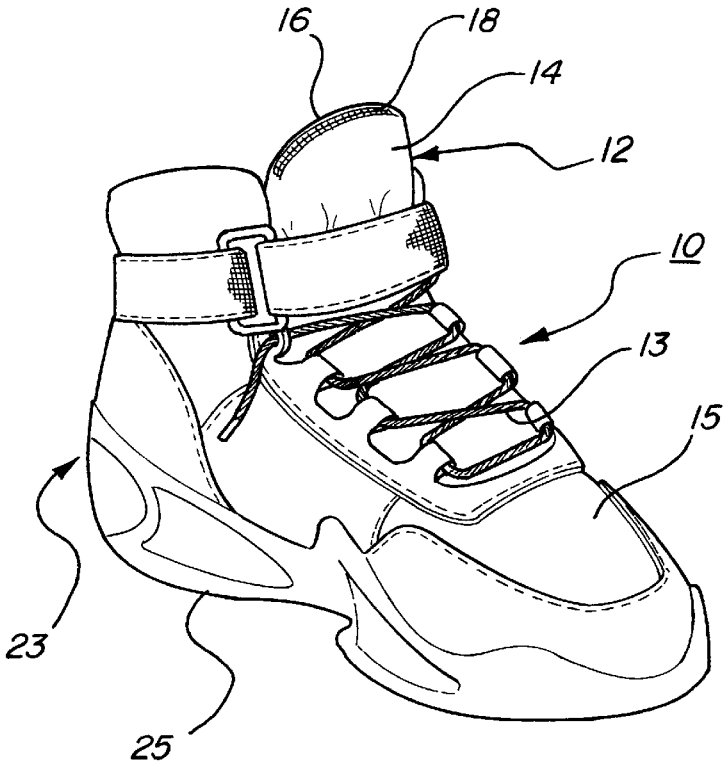
FIG. 1 is a perspective view showing one side of the shoe of this invention.

Referring now to the drawings, there is shown an illustrative embodiment of the invention in an athletic shoe which incorporates a storage compartment in the heel and a storage pocket in the tongue. It will be appreciated that the invention may be used in other shoe styles and may be realized in a wide variety of modifications. Obviously, either storage facility is useful without the other in the same shoe or both may be used in the same shoe.

As shown in FIG. 1, the shoe 10 is provided with an elongated tongue 12 which extends from the bottom of the lacing 13 and terminates in its free end at a level somewhat above the upper 15 of the shoe 10. The tongue 12 is constructed with front and rear layers 14 and 16, respectively, of soft flexible material such as fabric, leather, or plastic. The tongue 12 defines a pocket between the layers 14 and 16 and has a zipper 18 as a closure at the upper extremity of the tongue 12. The front and rear layers 14 and 16 are joined together along both side edges and across the tongue 12 at a desired depth to define the limits of the pocket. A zipper 18 extends across the top of the tongue 12 and may, if desired, extend part way down the sides to provide a wide mouth to facilitate access to the contents of the pocket. Further, the extended length of the tongue 12 above the upper 13 permits the tongue 12 to be tilted downwardly to empty the contents of the pocket.

Figure 2:
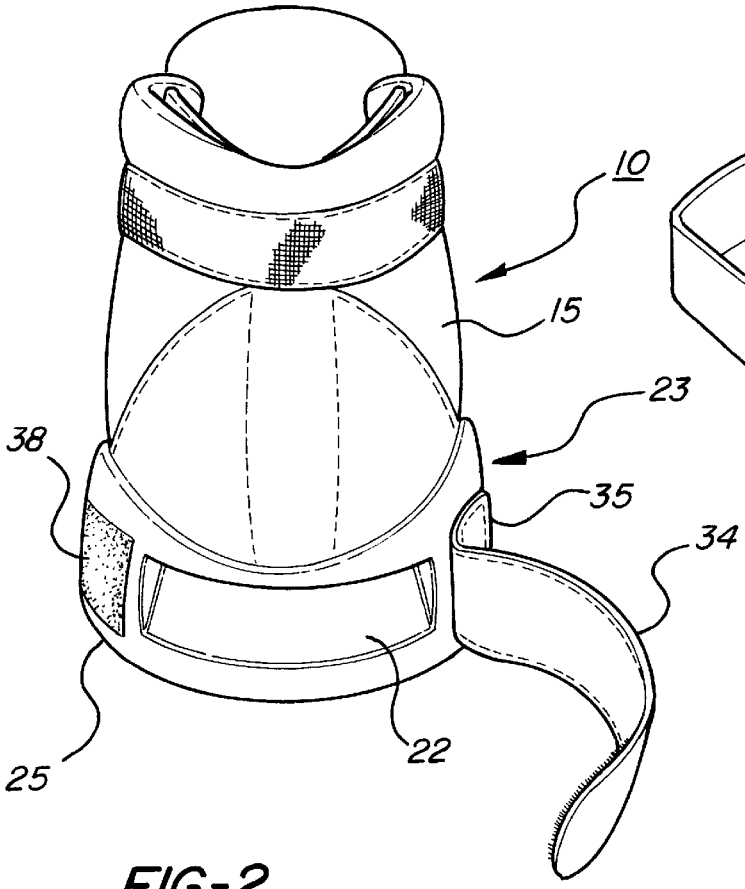
FIG. 2 is a rear elevation view of the shoe showing a storage compartment in the heel.
Figure 3:
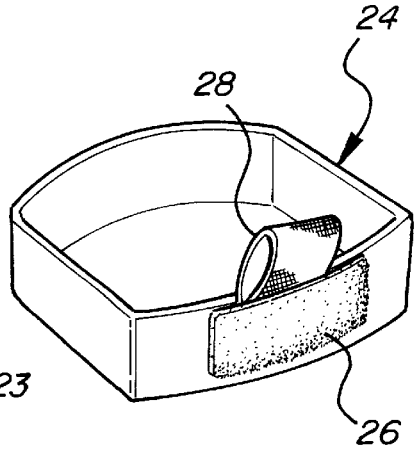
FIG. 3 is a perspective view of a storage drawer for the shoe.

A storage compartment 22 is disposed in a heel portion 23 of the shoe sole 25 and is adapted to receive a drawer 24 as shown in FIGS. 2 and 3. The heel compartment 22 is open at the rear of the shoe 10 and comprises a generally rectangular space extending into the heel 23 of the sole 25. The compartment 22 is formed by molding it in the sole 25 to be integrally formed with the sole 25.

The drawer 24 is an open-topped box of substantially rectangular shape. It is made of molded plastic and is sized to slidably fit within the compartment 22. The drawer 24 is provided with a drawer pull 26 adhesively attached to a back face 27 of the drawer 24 and is constructed of fabric with a handle portion 28.

As shown in FIG. 2, a compartment closure is provided comprising a closure strap 34 having a first end 35 permanently connected to the outer surface of the heel 23 adjacent one side of the compartment 22. The strap 34 includes a fastener portion 36 at its free end 37, preferably a hook-and-loop fastener such as Velcro. A mating fastener portion 38 is secured to the heel 23 for receiving the fastener portion 36 to hold the strap 34 in place.

In use, after the drawer 24 is inserted into the compartment 22, the strap 34 is pulled across the compartment with the fastener parts 36, 38 engaged to securely contain the drawer 24 and its contents within the compartment 22. If desired, the storage compartment 22 can be used without the drawer 24 for storing certain types of articles. In either case, the contents of the compartment 22 are readily accessible by opening the closure strap 34 while the shoe 10 is being worn or otherwise.

Figure 4:
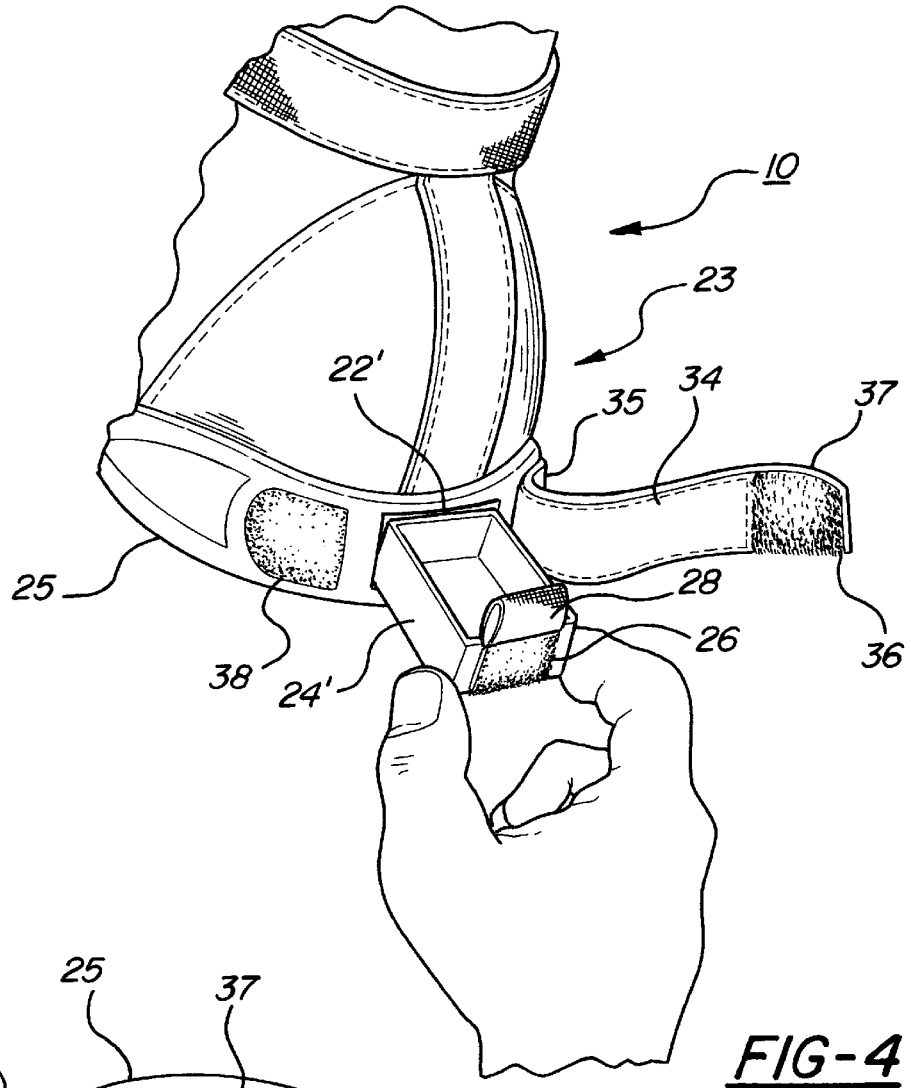
FIG. 4 is a perspective view showing a second embodiment of the storage drawer being inserted into the storage compartment in the heel.
Figure 5:
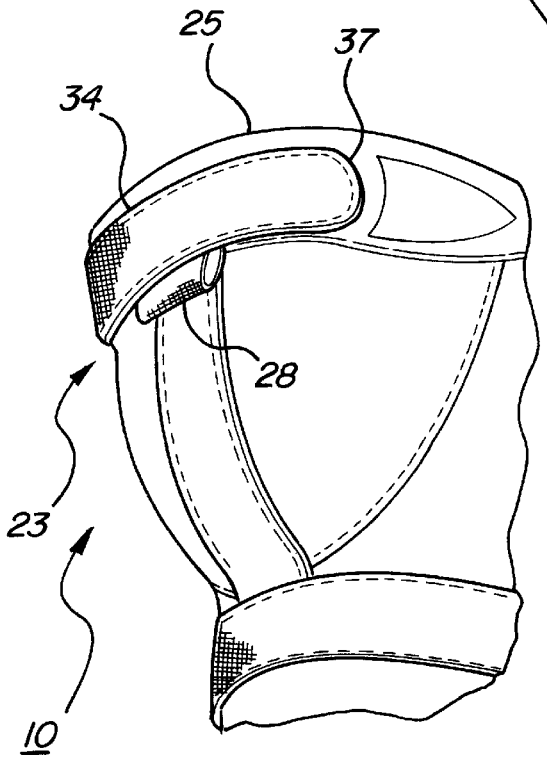
FIG. 5 is an inverted view of the shoe showing the storage compartment of FIG. 4 in a closed condition.

FIGS. 4 and 5 show a second embodiment similar to that of FIG. 2 wherein the compartment 22' and the drawer 24' in FIG. 4 are relatively narrower than the compartment 22 and drawer 24 of FIG. 2.

Figure 6:
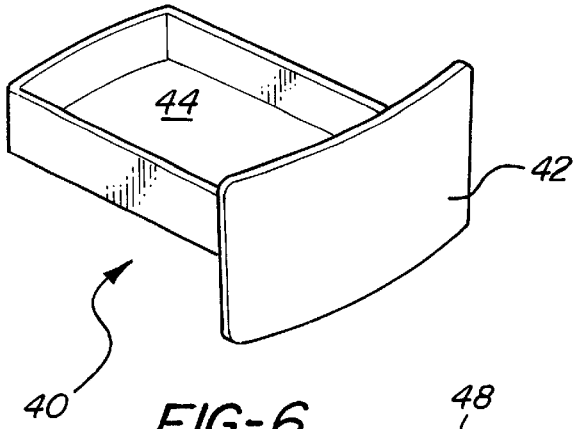
FIG. 6 is a perspective view of a third embodiment of the storage drawer.
Figure 7:
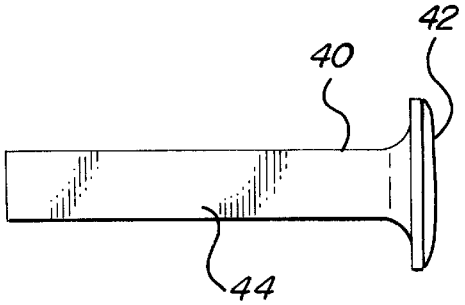
FIG. 7 is a side view of the storage drawer of FIG. 6.

FIGS. 6–10 illustrate a third embodiment of the invention including modifications to the drawer and closure strap. As shown in FIGS. 6 and 7, the drawer 40 is a rectangular open topped box including a back face 42 comprising an outwardly extending flange. The back face 42 extends outwardly beyond the outer periphery of a storage portion 44 of the drawer 24 and prevents the drawer 40 from being inserted too far into the heel 23 of the shoe 10. The back face 42 also overlaps the opening of the compartment 22 in the heel 23 to prevent water or other debris from entering the sole 25.

Figure 8:
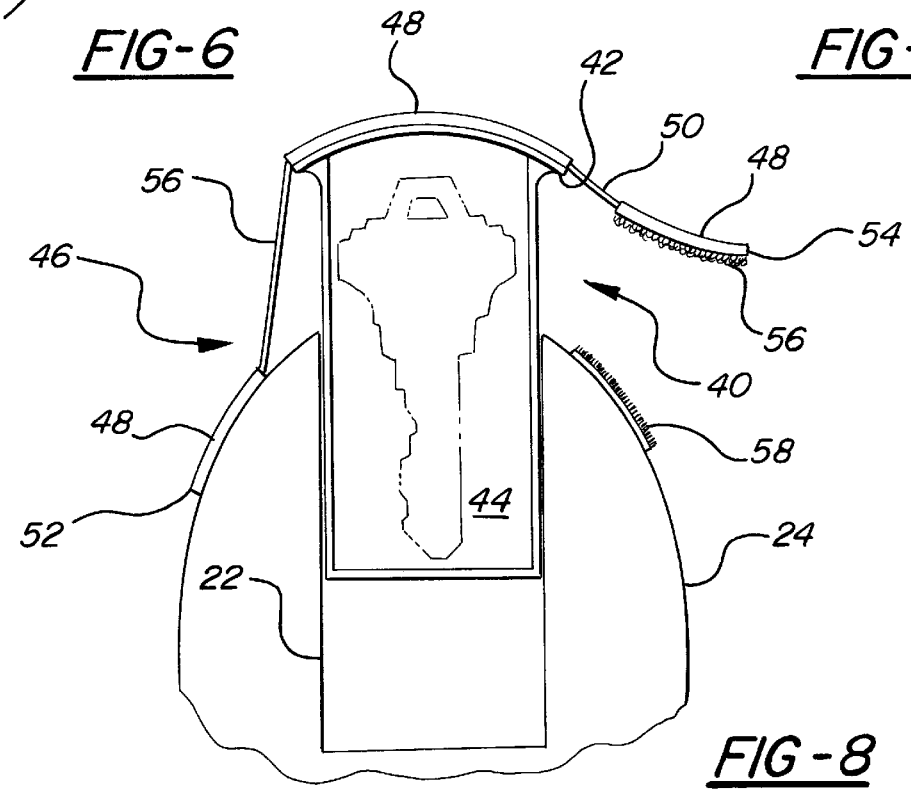
FIG. 8 is top view of the storage drawer of FIG. 6 being inserted into the storage compartment in the heel.
Figure 9:
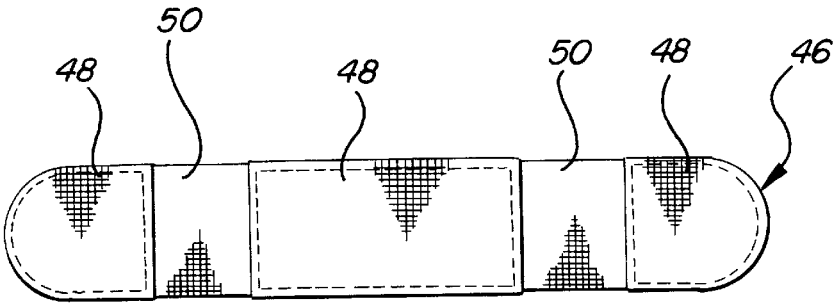

As shown in FIGS. 8–10, a modified closure strap 46 is provided which includes three fabric sections 48 separated by elastic sections 50. A first fabric section 48 at a first end 52 of the closure strap 46 is joined to the shoe 10 as shown in FIG. 10, and a middle fabric section 48 is joined to the back face 42 of the drawer 40. A third fabric section 48 at a free end 54 of the strap 46 includes a fastener 56 for joining the free end 54 to the shoe 10. The fastener 56 preferably comprises a hook and loop fastener which mates with a corresponding fastener portion 58 on the shoe 10. The drawer 40 is made from rubber or other resilient material to match the sole 25 of the shoe 10.

Thus, with the third embodiment of the invention, the drawer 40 is permanently attached to the shoe sole 25 by the elastic closure strap 46. The drawer 40 may be pulled out of the compartment 22 merely by stretching the strap 46 as the drawer 40 is withdrawn, and the drawer 40 may be secured to the shoe sole 25 by joining the fastener mechanism 56 on the free end of the strap 46 with the mating fastener mechanism 56 on the shoe sole 25.

As shown in FIGS. 6–9, the storage portion 44 of the drawer 40 is preferably six centimeters long, three centimeters wide, and one centimeter tall. The back face 42 of the drawer 40 is preferably two centimeters tall and four centimeters wide. As shown in FIG. 9, the closure strap 46 is preferably eleven centimeters long and two centimeters wide.

Figure 13:
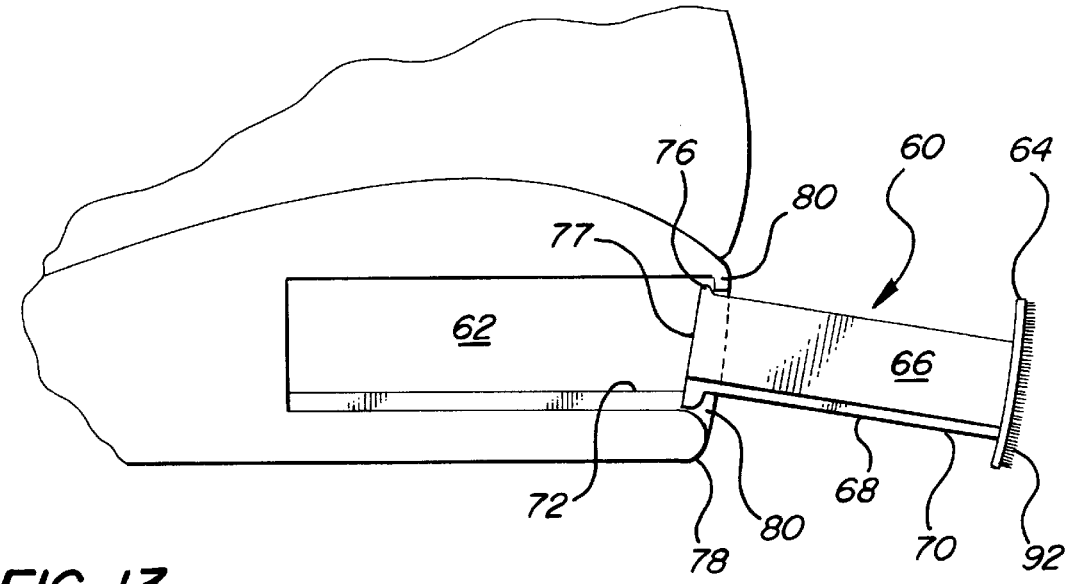
FIG. 13 is a partial cross sectional view of the fourth embodiment of the invention illustrating the storage drawer being inserted into the storage compartment in the heel.
Figure 14:
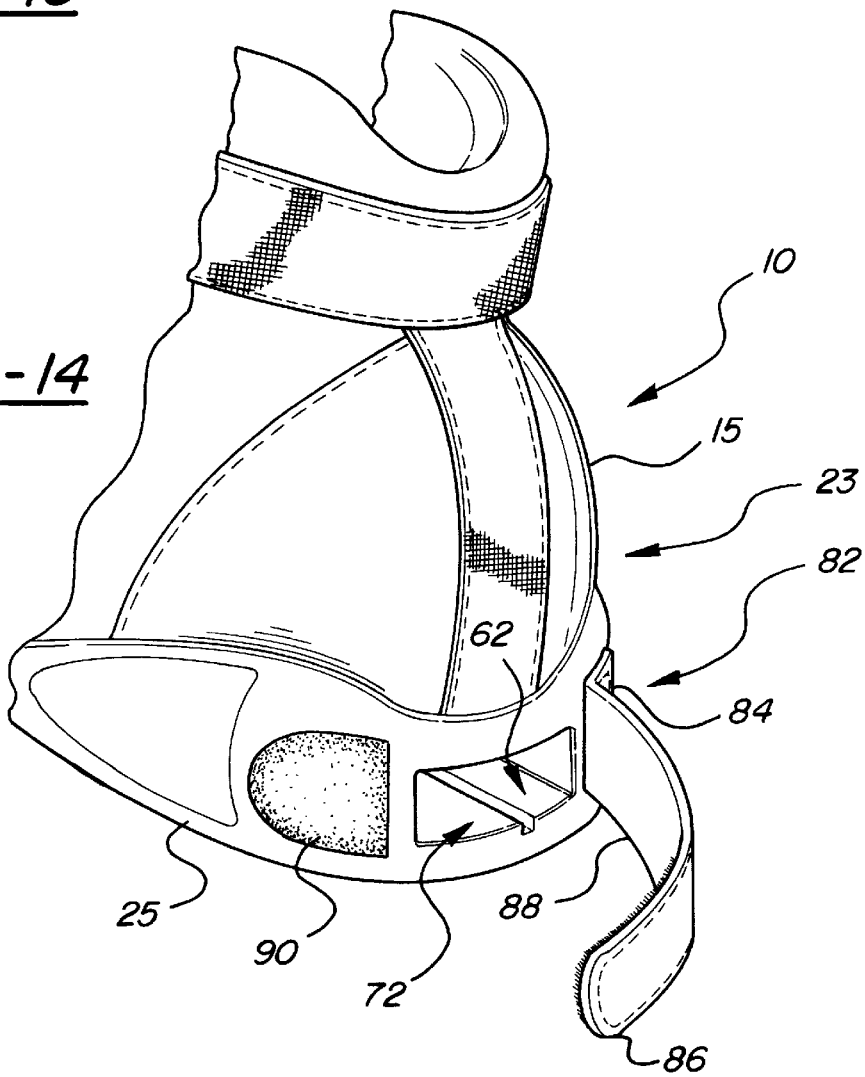
FIG. 14 is a rear perspective view of the fourth embodiment of the invention illustrating the storage compartment in the heel of the shoe.

A fourth embodiment of the invention is shown in FIGS. 11–14 and includes a drawer 60 adapted to be slidably received within a compartment 62 in the heel 23 of the sole 25. As shown in FIGS. 11–13, the drawer 60 is a rectangular open topped box including a back face 64 extending outwardly from the storage compartment 66 of the drawer 60. As shown in FIGS. 11 and 13, the drawer 60 also includes a guide rail 68 on a bottom surface 70 thereof extending longitudinally along the center of the bottom surface 70. The guide rail 68 is adapted to engage a guide slot 72 extending longitudinally along the center of the bottom surface 74 of the storage compartment 62, as shown in FIGS. 13 and 14. In this manner, the drawer 60 can be easily guided for insertion and removal from the heel 23.

The drawer 60 includes an upwardly extending ridge 76 on a front face 77 of the drawer 60. The guide rail 68 also includes a downwardly extending nub 78 at the end of the guide rail 68 adjacent the front face 77 of the drawer 60. As shown in FIG. 13, the ridge 76 and nub 78 engage with inwardly extending flanges 80 at the opening of the compartment 22 to prevent the drawer 60 from being removed from the compartment 62 unless sufficient force is applied to the drawer 60. The drawer 60 is made of rubber similar to the sole 25 of the shoe 10 and can be withdrawn from the shoe 10 by slightly deforming the drawer 60 to overcome the inwardly extending flanges 80.

As shown in FIG. 14, a closure strap 82 is provided including a first end 84 permanently attached to the shoe sole 25 on one side of the compartment 62. The strap 82 includes a free end 86 having a fastener mechanism 88 adapted to engage with a mating fastener mechanism 90 on an opposite side of the compartment 62. The strap 82 also includes a fastener mechanism 88 along a middle portion thereof adapted to engage with a mating fastener 92 on the back face 64 of the drawer 60, as shown in FIGS. 11–13. Thus, after the drawer 60 is inserted within the compartment 62, the closure strap 82 is extended across the sole 25 until the fastener mechanism 88 on the strap 82 engages with the corresponding fastener mechanisms 90, 92 on the drawer 60 and on the sole 25. As with the previous embodiments, the fastener mechanism preferably comprises a hook and loop retainer such as Velcro.

Although the description of this invention has been given with reference to a particular embodiment, it is not to be construed in a limiting sense. Many variations and modifications will now occur to those skilled in the art.

What is claimed is:

1. A shoe comprising:

an upper;

a sole joined to said upper and including a heel;

said heel including a compartment having an opening;

said heel including a flange extending inwardly from a peripheral edge of said opening;

a drawer adapted to be slidably received within said compartment;

said drawer including a bottom surface, a front end, and a back end; and said drawer including a projection adapted to engage said flange to prevent complete withdrawal of said drawer from said compartment.

2. The shoe of claim 1 wherein said drawer includes an upwardly extending projection adjacent said front end and a downwardly extending projection on said bottom surface adjacent said front end which are adapted to engage with said flange surrounding said opening.

3. The shoe of claim 1 further comprising a guide rail on said bottom surface of said drawer adapted to engage a guide slot on a bottom surface of said compartment.

4. The shoe of claim 3 wherein said downwardly extending projection is disposed on a rear end of said guide rail and said upwardly extending projection comprises a rail extending from an upper edge of said front end of said drawer.

5. The shoe of claim 1 further comprising:

a closure strap including a first end fastened to said shoe on a first side of said compartment openings and a second end having one portion of a fastener adapted to engage with a mating portion of said fastener on said shoe at a location opposite said first side of said compartment opening.

6. The shoe of claim 5 wherein said fastener comprises a hook and loop fastener.

7. The shoe of claim 6 wherein said drawer includes a back side larger than said opening in said compartment and said closure strap includes a middle region having one portion of said fastener adapted to engage with a mating portion of said fastener disposed on said back side of said drawer.

8. The shoe of claim 6 wherein said drawer comprises a rectangular open-topped box.

9. The shoe of claim 1 further comprising:

a tongue joined to said upper including first and second layers defining a pocket therebetween; and a closure mechanism adapted to join said first and second layers together to close said pocket.

10. A shoe comprising:

an upper;

a sole joined to said upper and including a heel;

said heel including a compartment having an opening;

a drawer adapted to be slidably received within said compartment;

said drawer including a back side which faces outwardly from said compartment;

a closure strap including a first end fastened to said shoe on a first side of said compartment opening;

said closure strap including a second end having one portion of a fastener adapted to engage with a mating portion of said fastener on said shoe at a location opposite said first side of said compartment opening; and said closure strap including a middle portion joined to said back side of said drawer and an elastic portion between said first end and said middle.

11. The shoe of claim 10 wherein said fastener comprises a hook-and-loop fastener.

12. The shoe of claim 10 wherein said drawer is made of rubber.

13. The shoe of claim 10 wherein said back side of said drawer is larger than said opening in said compartment.

14. The shoe of claim 10 wherein said drawer comprises a rectangular open-topped box.

15. The shoe of claim 10 further comprising:

a tongue joined to said upper including first and second layers defining a pocket therebetween; and a closure mechanism adapted to join said first and second layers together to close said pocket.

16. A shoe comprising:

an upper;

a sole joined to said upper and including a heel;

said heel including a compartment having an opening;

a drawer adapted to be slidably received within said compartment;

a closure strap including a first end fastened to said shoe on a first side of said compartment opening; and said closure strap including a second end having one portion of a hook-and-loop fastener adapted to engage with a mating portion of said fastener on said shoe at a location opposite said first side of said compartment opening.

17. The shoe of claim 16 wherein:

said drawer includes a back side which faces outwardly from said compartment; and said closure strap includes a middle having one portion of a hook-and-loop fastener adapted to engage with a mating portion of said fastener on said back side of said drawer.

18. The shoe of claim 16 wherein said drawer comprises a rectangular open-topped box.

19. The shoe of claim 17 further comprising:

a tongue joined to said upper including first and second layers defining a pocket therebetween; and a closure mechanism adapted to join said first and second layers together to close said pocket.

* * * * *